US007530338B2

(12) United States Patent
Falkowski et al.

(10) Patent No.: US 7,530,338 B2
(45) Date of Patent: May 12, 2009

(54) VALVETRAIN SYSTEM FOR AN ENGINE

(75) Inventors: Alan G Falkowski, Lake Orion, MI (US); Richard H Sands, Holly, MI (US); Christopher P Thomas, Commerce, MI (US); David W Fiddes, Lake Orion, MI (US); Anteo Opipari, Grand Blanc, MI (US)

(73) Assignee: Chrysler LLC, Auburn Hills, MI (US)

( * ) Notice: Subject to any disclaimer, the term of this patent is extended or adjusted under 35 U.S.C. 154(b) by 366 days.

(21) Appl. No.: 11/279,621

(22) Filed: Apr. 13, 2006

(65) Prior Publication Data

US 2006/0236968 A1 Oct. 26, 2006

Related U.S. Application Data

(60) Provisional application No. 60/675,056, filed on Apr. 26, 2005.

(51) Int. Cl.
*F01L 1/18* (2006.01)

(52) U.S. Cl. ..... 123/90.39; 123/90.16; 123/90.44; 74/559

(58) Field of Classification Search ..... 123/90.16, 123/90.2, 90.27, 90.31, 90.39, 90.44, 90.45, 123/90.46; 74/559, 567, 569
See application file for complete search history.

(56) References Cited

U.S. PATENT DOCUMENTS 4,656,977 A 4/1987 Nagahiro et al.
4,799,463 A 1/1989 Konno
4,823,747 A 4/1989 Wagner et al.
4,829,948 A 5/1989 Yoshida et al.
4,844,023 A * 7/1989 Konno et al. ..... 123/90.16
5,099,806 A 3/1992 Murata et al.
5,150,675 A 9/1992 Murata
5,297,506 A 3/1994 Reckziigel et al.
5,370,090 A 12/1994 Murata et al.
5,370,099 A 12/1994 Koelle et al.
5,394,841 A * 3/1995 Murakami ..... 123/90.15
5,417,191 A * 5/1995 Togai et al. ..... 123/333
5,429,070 A 7/1995 Campbell et al.
5,435,281 A 7/1995 Regueiro
5,458,099 A 10/1995 Koller et al.
5,460,130 A 10/1995 Fukuzawa et al.
5,495,832 A 3/1996 Fujii et al.
5,529,032 A 6/1996 Oikawa et al.
5,553,584 A 9/1996 Konno (Continued)

*Primary Examiner*—Ching Chang
(74) *Attorney, Agent, or Firm*—Ralph E. Smith

(57) ABSTRACT

A variable lift deactivateable valvetrain system for an engine is provided. The system includes a camshaft, a rocker shaft, a valve and at least one rocker arm rotateably connected to the rocker shaft and arranged to engage the camshaft. A connecting rocker arm is rotateably connected to the rocker shaft and is in constant engagement with the valve. The connecting rocker arm is arranged to operate in selective engagement with the at least one rocker arm to provide a variable lift deactivateable valvetrain configuration. The system further includes a low lift rocker arm having a low lift pin assembly and a high lift rocker arm having a high lift pin assembly. The low and high lift pin assemblies are arranged to selectively engage the connecting rocker arm responsive to oil pressure selectively directed to the low and high lift pin assemblies.

17 Claims, 7 Drawing Sheets

U.S. PATENT DOCUMENTS

| | | | |
|---|---|---|---|
| 5,592,907 | A | 1/1997 | Hasebe et al. |
| 5,651,337 | A | 7/1997 | Regueiro |
| 5,704,315 | A | 1/1998 | Tsuchida et al. |
| 5,845,614 | A | 12/1998 | Tanaka et al. |
| 5,960,754 | A | 10/1999 | Sugimoto et al. |
| 5,979,379 | A | 11/1999 | Sato et al. |
| 6,125,805 | A | 10/2000 | Sato et al. |
| 6,186,102 | B1 | 2/2001 | Kosuge et al. |
| 6,318,315 | B1 | 11/2001 | Harada et al. |
| 6,347,606 | B1 | 2/2002 | Tanaka et al. |
| 6,347,607 | B2 | 2/2002 | Tanaka et al. |
| 6,412,460 | B1 | 7/2002 | Sato et al. |
| 6,431,135 | B2 | 8/2002 | Tanaka et al. |
| 6,463,899 | B2 | 10/2002 | Tanaka et al. |
| 6,467,444 | B2 | 10/2002 | Tanaka et al. |
| 6,470,841 | B2 | 10/2002 | Takahashi et al. |
| 6,550,432 | B2 | 4/2003 | Takahashi et al. |
| 6,615,781 | B2 | 9/2003 | Tanaka et al. |
| 6,644,254 | B2 | 11/2003 | Harada et al. |
| 6,796,281 | B2 | 9/2004 | Shimoyama et al. |
| 6,871,622 | B2 | 3/2005 | Mandal et al. |

* cited by examiner

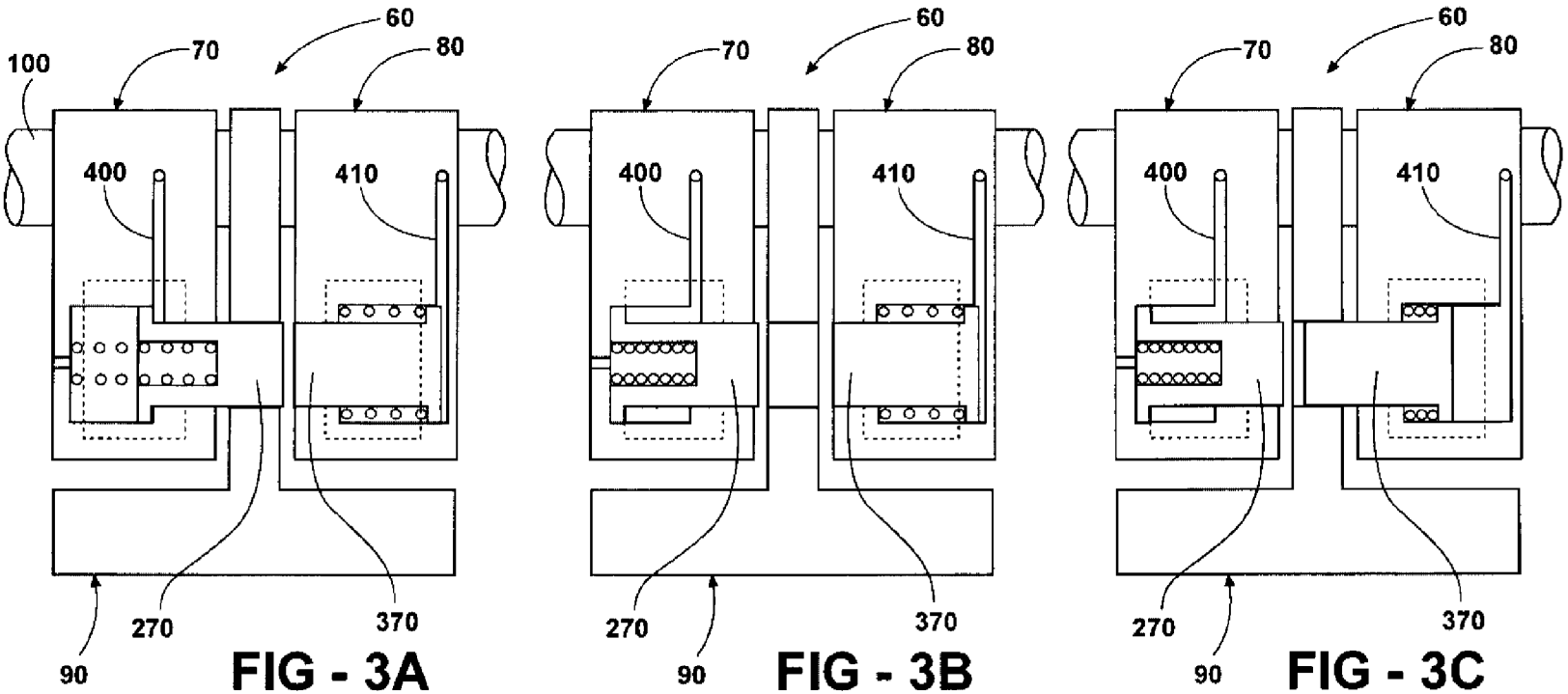
FIG - 3A
FIG - 3B
FIG - 3C
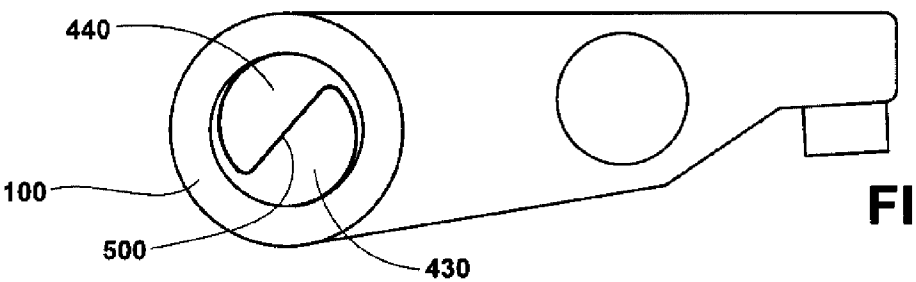
FIG - 5

VALVETRAIN SYSTEM FOR AN ENGINE

CROSS REFERENCE TO RELATED APPLICATION(S)

This application claims benefit of U.S. Provisional Application Ser. No. 60/675,056 filed Apr. 26, 2005.

FIELD OF INVENTION

The present invention relates generally to a valvetrain system for an engine and, more particularly, to a variable lift deactivateable valvetrain system for an engine.

BACKGROUND OF INVENTION

In today's competitive automotive industry, it is becoming increasingly important for automotive manufacturers to deliver refined engines that offer strong performance while also balancing fuel economy considerations. Cylinder deactivation is being explored in the automotive industry as one option to increase fuel economy by deactivating certain cylinders of an engine when there is not a demand for such cylinders. Often such cylinder deactivation systems involve add on hardware that increases the cost and complexity of manufacturing the engines as well as requires additional parts that may increase the potential for long term durability concerns.

In addition, while the aforementioned cylinder deactivation systems are designed to improve fuel economy, such systems are generally not designed to increase engine performance. Similar to cylinder deactivation, the automotive industry has also been exploring variable lift valvetrains to improve engine performance under certain engine operating conditions. Generally, such variable lift systems have also required the addition of complex components that are independent of the cylinder deactivation hardware. These variable lift systems have thus resulted in a complex and costly valvetrain that is difficult to manufacture and potentially prone to durability issues.

Another disadvantage associated with both the cylinder deactivation systems and the variable lift systems is that the size and complexity of the add on hardware for each independent system results in a larger cylinder head that is difficult to package in today's relatively congested under hood engine compartment. Such a larger cylinder head is more expensive to manufacture and adds additional weight to the engine which is counterproductive to the goals of improving fuel economy and other engine performance characteristics.

Thus, there is a need for a compact variable lift deactivateable valvetrain system that overcomes the aforementioned and other disadvantages.

SUMMARY OF INVENTION

Accordingly, a variable lift deactivateable valvetrain system for an engine is provided. In accordance with one aspect of the present invention, the valvetrain system includes a camshaft, a rocker shaft, a valve, and at least one rocker arm rotateably connected to the rocker shaft and arranged to engage the camshaft, the at least one rocker arm includes one of a low lift rocker arm and a high lift rocker arm. A connecting rocker arm is rotateably connected to the rocker shaft and is in engagement with the valve. The connecting rocker arm is arranged to operate in selective engagement with the at least one rocker arm to provide a variable lift deactivateable valvetrain configuration.

In accordance with another aspect of the present invention, the valvetrain system includes a low lift rocker arm, a low lift pin assembly positioned in the low lift rocker arm, a high lift rocker arm and a high lift pin assembly positioned in the high lift rocker arm. The low lift and high lift pin assemblies are arranged to selectively engage the connecting rocker arm responsive to oil pressure directed to a one of the low and high lift pin assemblies.

BRIEF DESCRIPTION OF DRAWINGS

Other aspects, features, and advantages of the present invention will become more fully apparent from the following detailed description of the preferred embodiment, the appended claims, and in the accompanying drawings in which:

FIGS. 3A-3C illustrate diagrammatic top views of the rocker arm arrangement of FIG. 2 in low lift, deactivation and high lift configurations, respectively in accordance with the present invention;

FIG. 5 illustrates a side view of a rocker shaft arrangement in accordance with the present invention;

DETAILED DESCRIPTION OF EXEMPLARY EMBODIMIENT(S)

Figure 1:
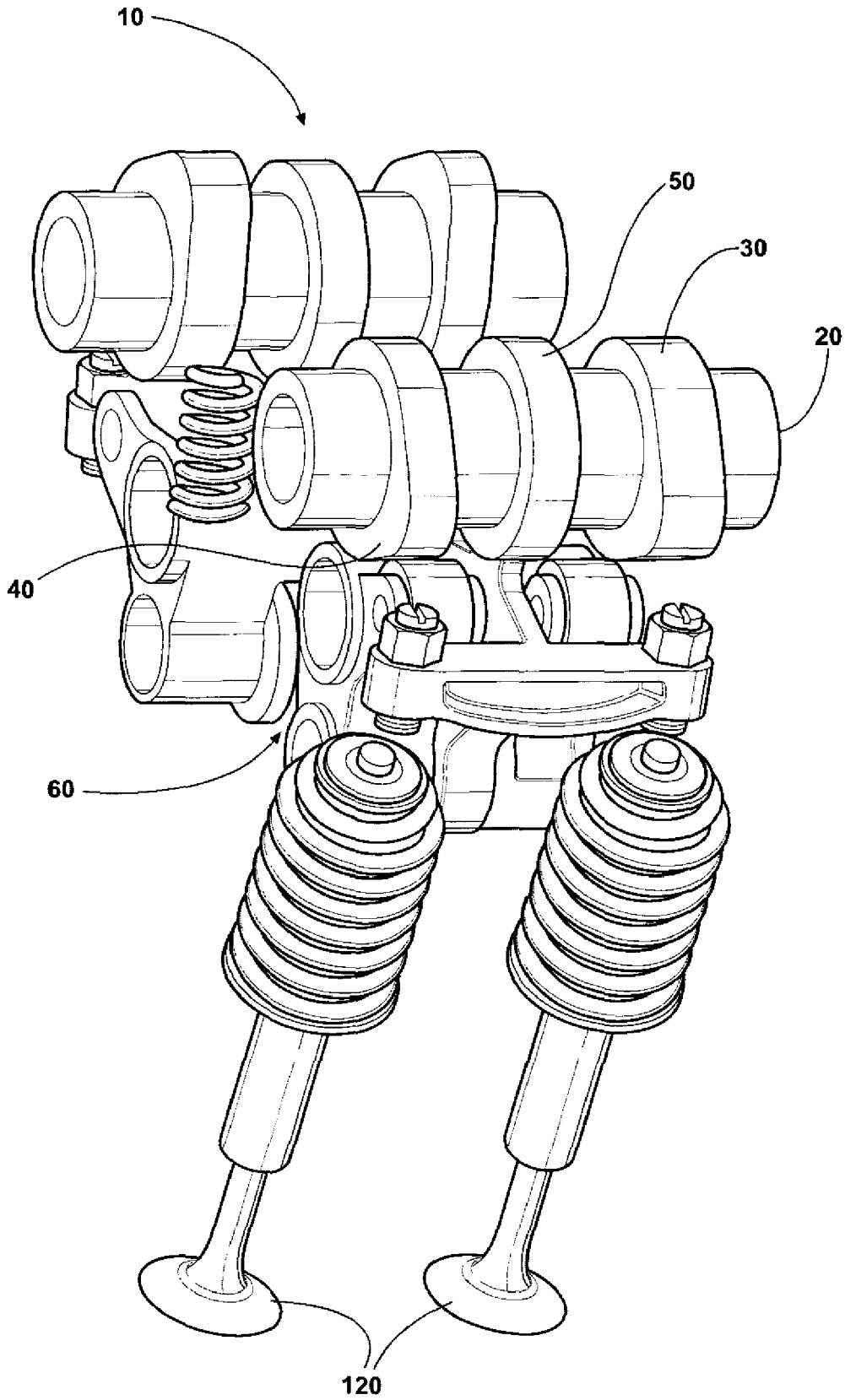
FIG. 1 illustrates an isometric view of a valvetrain assembly arrangement in accordance with the present invention.

In the following description, several well-known features of an internal combustion engine and more specifically a valvetrain for an internal combustion engine are not shown or described so as not to obscure the present invention. Referring now to the drawings, FIGS. 1-8 illustrate an exemplary embodiment of a variable lift deactivateable valvetrain for a dual over head camshaft (DOHC) internal combustion engine in accordance with the present invention. With more particular reference to FIGS. 1-3, a variable lift deactivateable valvetrain arrangement 10 is provided and includes a camshaft 20 having a high lift cam lobe profile 30, a low lift cam lobe profile 40, and a no-lift or deactivation cam lobe profile 50. Camshaft 20 is positioned in a cylinder head (not shown) and arranged to engage a rocker arm assembly 60 via the above-mentioned cam lobes.

Figure 2:
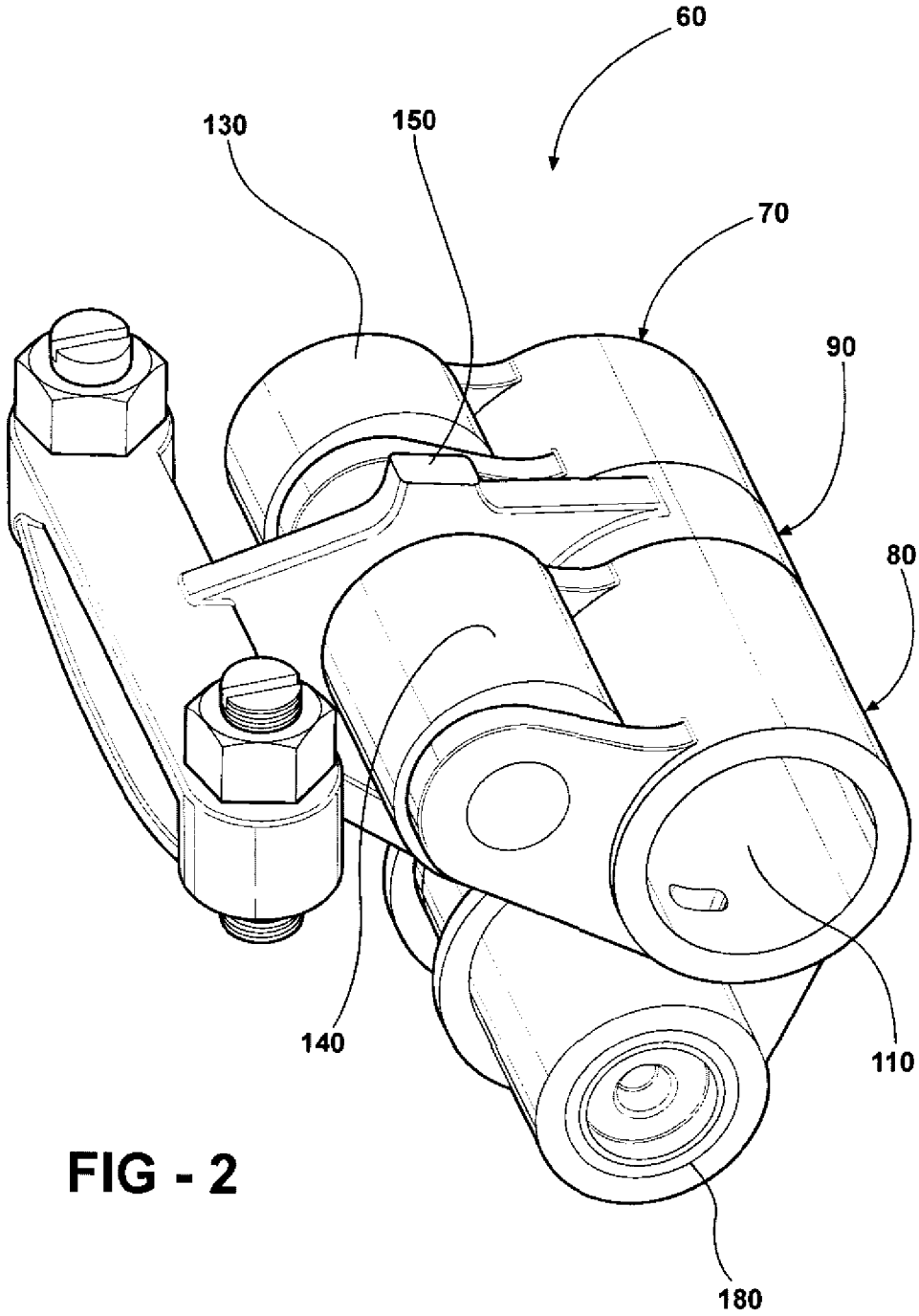
FIG. 2 illustrates an isometric view of a valvetrain rocker arm arrangement accordance with the present invention.

Rocker arm assembly 60 includes a low lift rocker assembly 70, a high lift rocker assembly 80 and a central connecting rocker assembly 90. Rocker assemblies 70, 80 and 90 are arranged to be positioned on and rotate about a rocker shaft 100 via axially aligned rocker shaft bores 110 in each of the low lift 70, high lift 80 and central connecting 90 rockers as best shown in FIGS. 2 and 3. Central connecting rocker 90 is arranged to engage at least one valve and is shown in the exemplary embodiment in a configuration arranged to engage a pair of valve assemblies 120. Rocker assemblies 70 and 80 each include respective rollers 130 and 140 arranged to engage a respective cam lobe profile of camshaft 20. In addition, central connecting rocker assembly 90 includes an engagement pad 150 arranged to engage the camshaft deactivation lobe profile 50 during a period cylinder deactivation operation.

Figure 6:
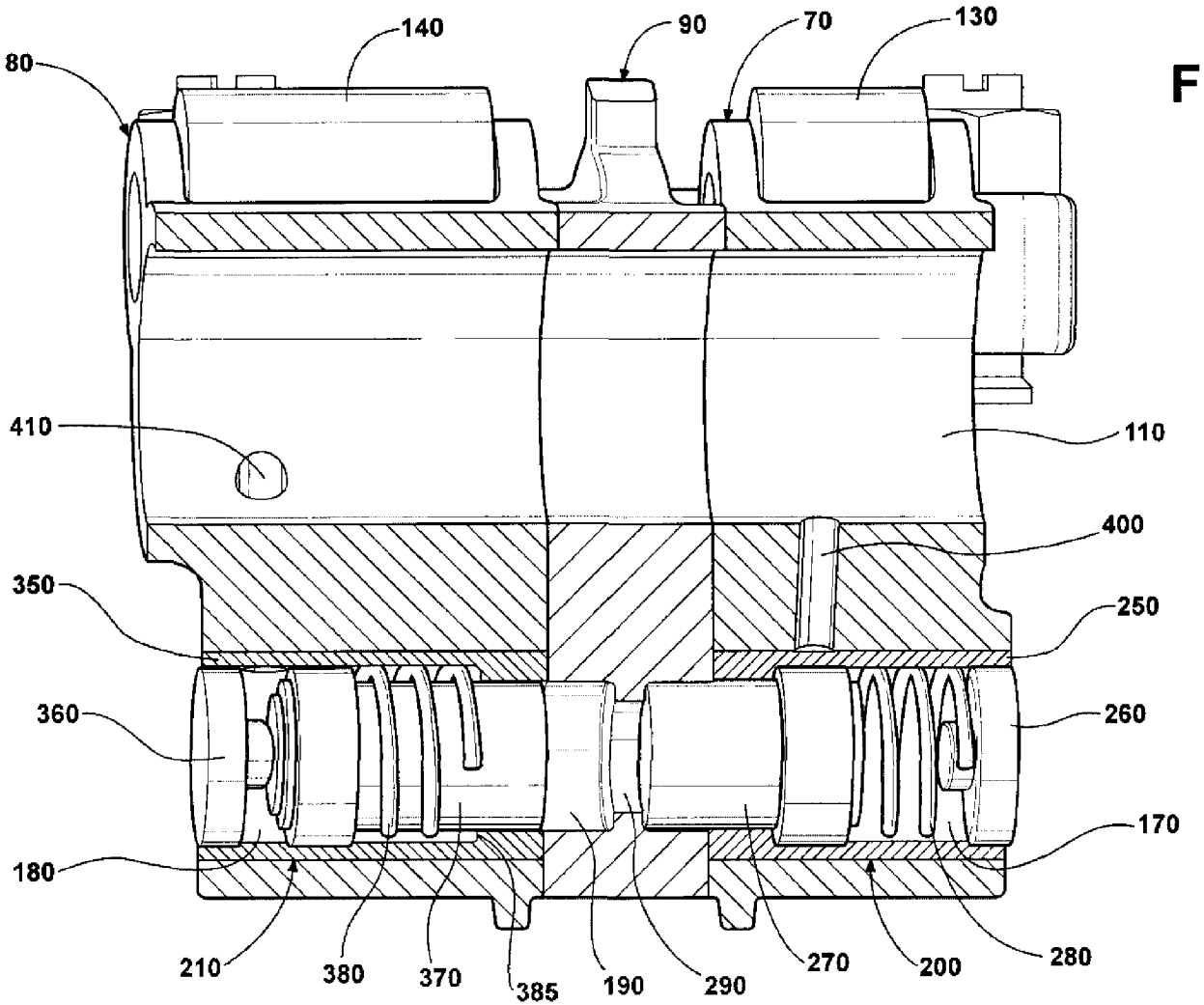
FIG. 6 illustrates a bottom sectional isometric view of the valvetrain rocker arm arrangement of FIG. 2 showing a pin assembly in the low lift configuration in accordance with the present invention.
Figure 7:
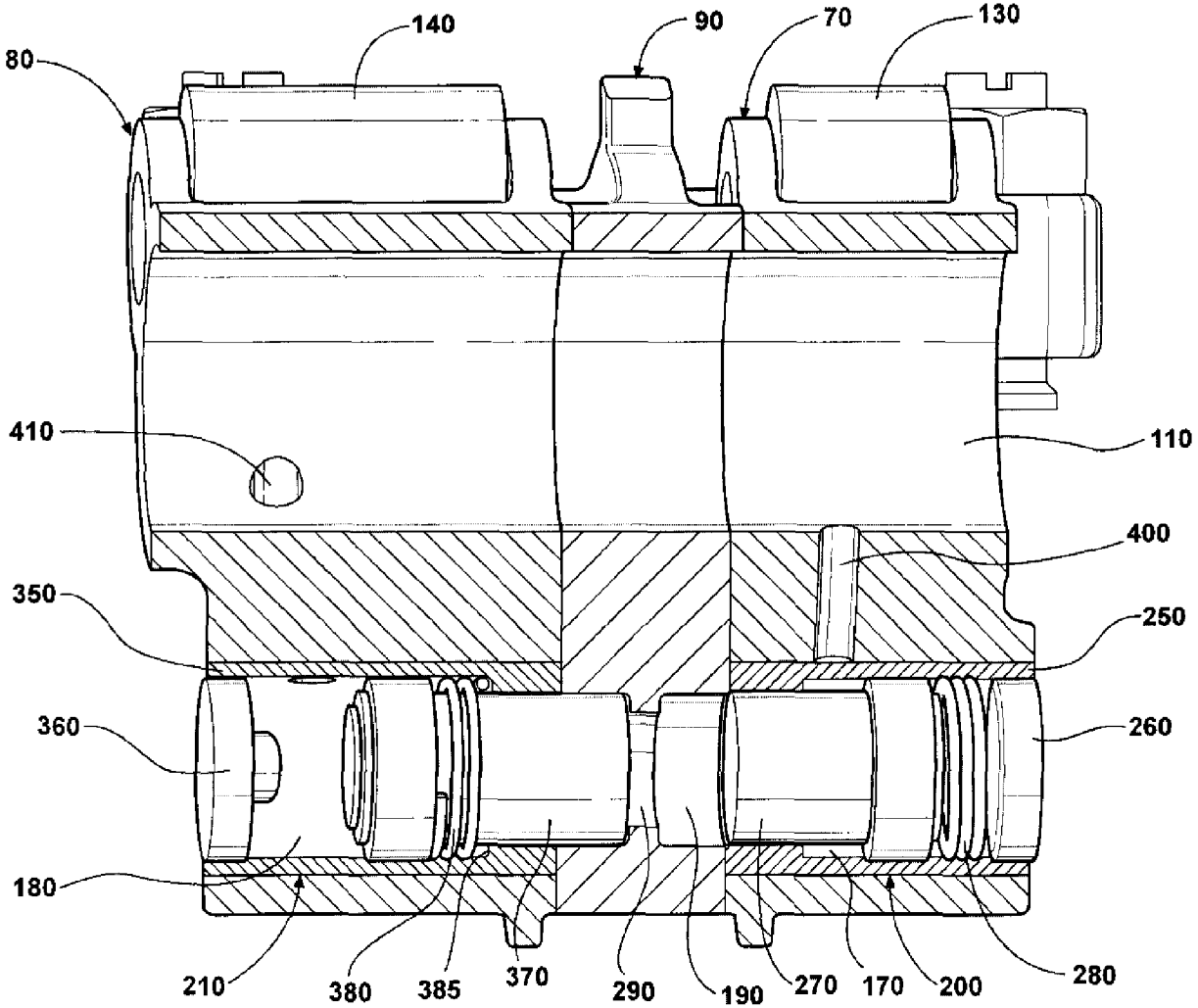
FIG. 7 illustrates a bottom sectional isometric view of the valvetrain rocker arm arrangement of FIG. 2 showing the pin assembly in the high lift configuration in accordance with the present invention.
Figure 8:
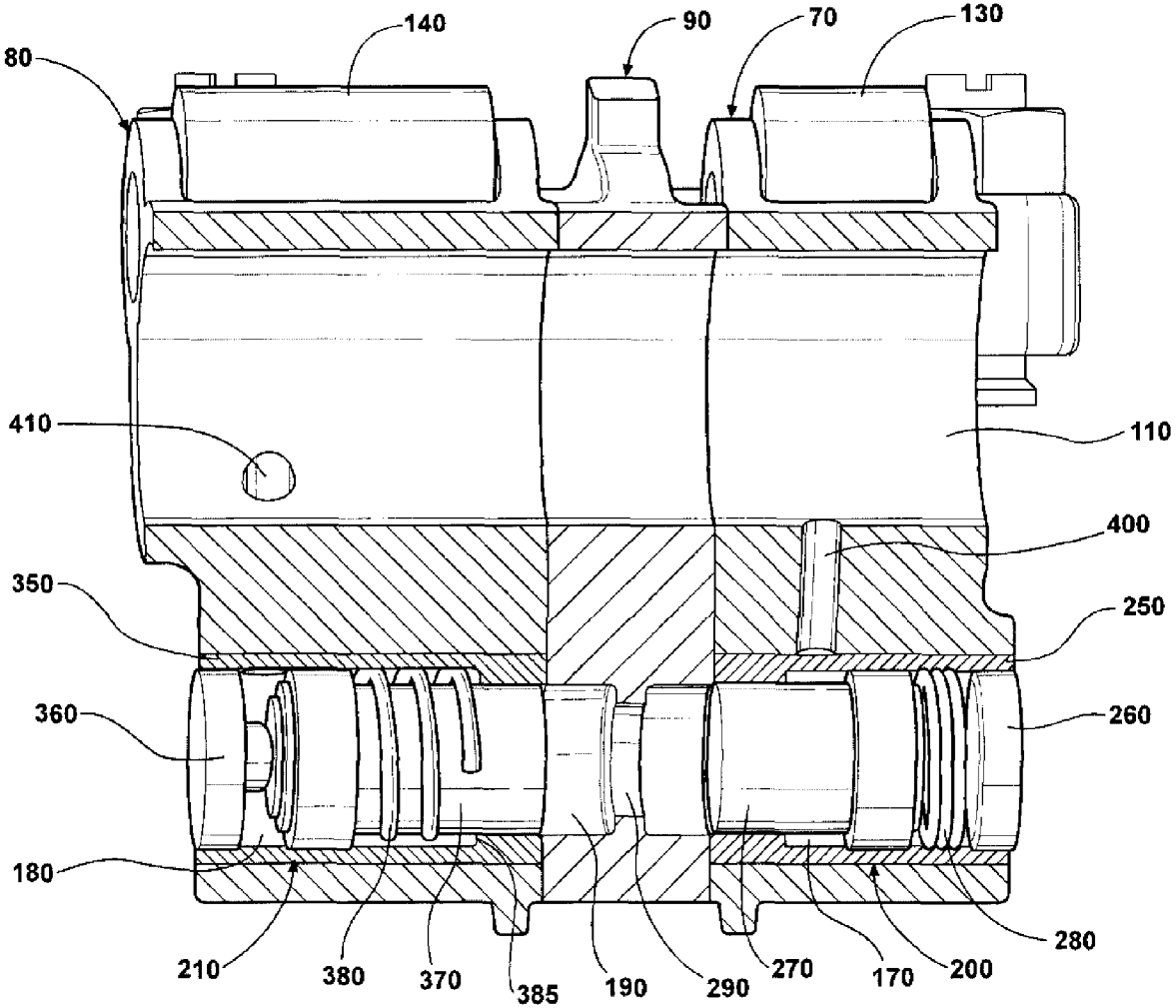
FIG. 8 illustrates a bottom sectional isometric view of the valvetrain rocker arm arrangement of FIG. 2 showing the pin assembly in deactivation configuration in accordance with the present invention.

Rocker assemblies 70 and 80 each include axially aligned locking mechanism bores 170, 180, respectively that house locking mechanism assemblies 200, 210, respectively as best shown in FIGS. 6-8. Connecting rocker assembly 90 includes a locking mechanism bore 190 positioned in axial alignment with bores 170, 180 and arranged to selectively engage a respective locking mechanism assembly for a desired valvetrain lift configuration as will be explained in more detail below. Rocker assemblies 70, 80 and 90 can pivot about rocker shaft 100 independent of each other or in selective engagement to each other based on desired engine valvetrain operating configurations of low lift, high lift or cylinder deactivation as will be described in more detail below.

Referring now in particular to FIGS. 6-8, the low lift and high lift locking mechanism assemblies 200, 210 will be described. Low lift locking mechanism assembly 200 includes a bushing 250 press fit in locking mechanism bore 170 and an end cap 260 press fit into an end of bushing 250. A low lift locking pin 270 is positioned in bushing 250 and biased towards the central connecting rocker locking mechanism bore 190 via a spring 280 positioned between low lift locking pin 270 and end cap 260. Central connecting rocker locking mechanism bore 190 also includes a pin stop 290 arranged to limit the travel of low lift locking pin 270.

High lift locking mechanism assembly 210 includes a bushing 350 press fit into locking mechanism bore 180 and an end cap 360 press fit into an end of bushing 350 as shown in FIG. 6. A high lift locking pin 370 is positioned in bushing 350 and biased away from central connecting rocker locking mechanism bore 190 towards end cap 360 via a spring 380 positioned between a bushing spring support 385 and end cap 360. Pin stop 290 also serves to limit the travel of high lift locking pin 370 in similar fashion to low lift locking pin 270.

Low lift and high lift rocker assemblies 70, 80 include oil feed channels that are positioned in the rockers to fluidly connect the respective rocker shaft bores to the respective locking mechanism bores for selective engagement of the locking pin assemblies 200, 210 with the central connecting rocker assembly 90. More specifically, low lift rocker assembly 70 includes an oil feed channel 400 that fluidly connects rocker shaft bore 110 in the low lift rocker to low lift locking mechanism bore 170. Likewise, high lift rocker assembly 80 includes an oil feed channel 410 that fluidly connects rocker shaft bore 110 in the high lift rocker arm to the high lift locking mechanism bore 180. The oil feed channels are arranged to supply pressurized oil to the respective locking mechanism bores for selective engagement of the low lift and high lift locking pins 270, 370, respectively with the central rocker assembly 90.

Figure 4:
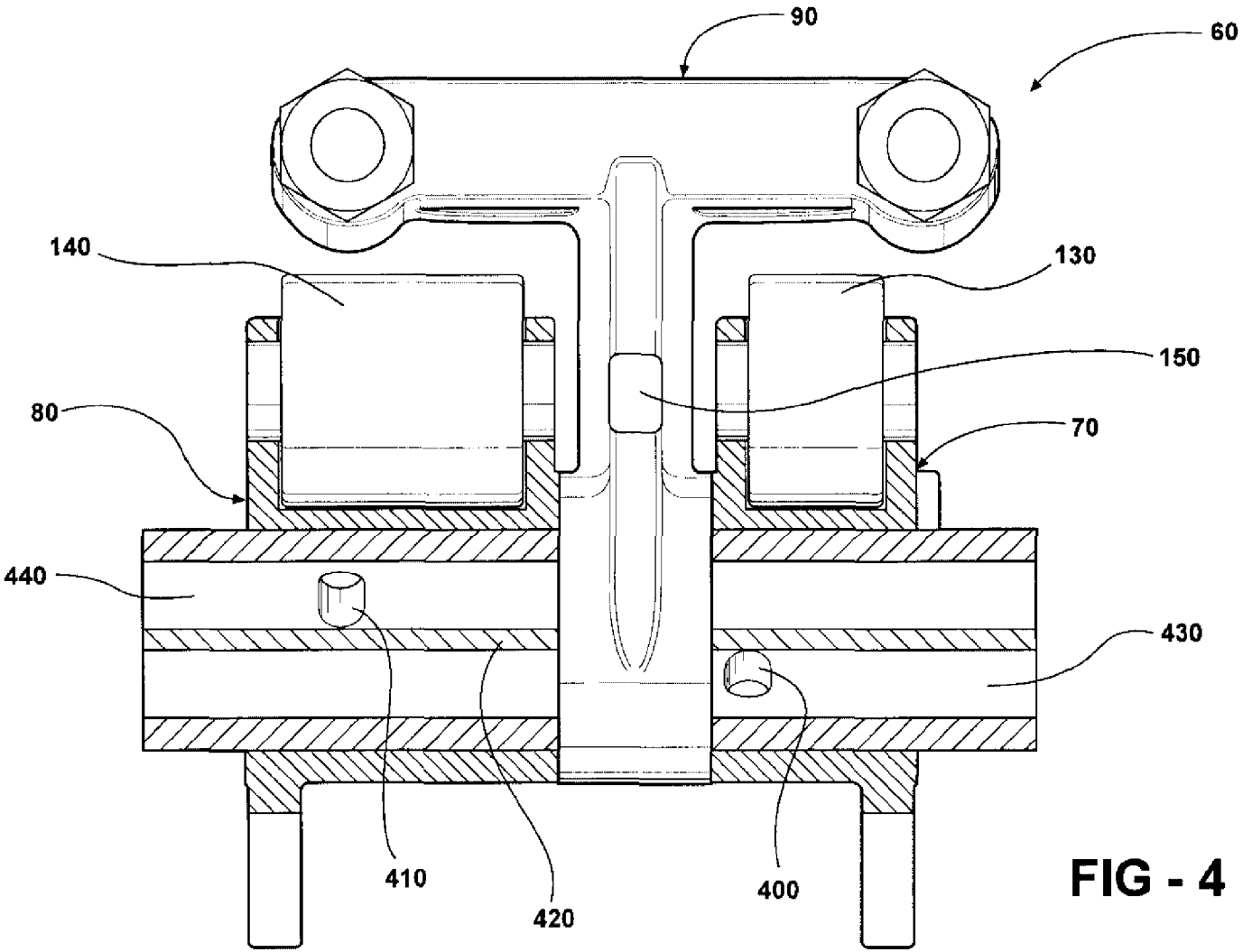
FIG. 4 illustrates a top view of the valvetrain rocker arm arrangement of FIG. 2 with a partial sectional view of a rocker shaft in accordance with the present invention.

As best shown in FIG. 4, rocker shaft 100 is tubular in construction having a hollow inner region that is arranged to selectively supply pressurized oil to the respective high and low lift oil feed channels 400, 410. A split rocker shaft arrangement is utilized to provide the ability to independently supply pressurized oil to the low and high lift oil feed channels 400, 410, respectively. More specifically, a divider 420 is positioned inside rocker shaft 100 that effectively splits an inside area of the rocker shaft into two semi-circular cross sections 430 and 440 running internally an axial length of the rocker shaft. As best shown in FIG. 4, oil feed channels 400, 410, respectively are positioned in their respective rocker assemblies such that they will intersect the inside diameter of rocker shaft 100 on different sides of divider 420. More specifically, low lift oil feed channel 400 is arranged to intersect the divided semi-circular region 430 that is farther from the low and high lift rollers 130, 140 whereas the high lift oil feed channel 410 is arranged to intersect the other semi-circular divided region 440 in rocker shaft 100 that is closer to the rollers 130, 140, respectively.

In an alternative arrangement as shown in FIG. 5, a spring loaded divider insert 500 is provided in place of divider 420 that is manufactured into the rocker shaft, and divider insert 500 is preferably made of a plastic material, but can be made of other suitable materials. The divider insert 500 functions in the same fashion as divider 420 and effectively separates rocker shaft 100 into two semi-circular internal cross-sectional regions arranged to selectively supply pressurized oil independently to the low and high lift oil feed channels 400, 410, respectively. For either divider arrangement, a valve arrangement, such as a solenoid valve, is attached to an oil supply end of rocker shaft 100 and arranged to provide a supply of pressurized oil into rocker shaft 100 for one or both of the high and low lift oil feed channels depending on the desired valvetrain lift configuration.

In operation for a high lift valvetrain configuration and referring to FIGS. 3C, 4 and 7, pressurized oil is selectively supplied to the high lift locking mechanism bore 180 via rocker shaft divided region 440 and high lift oil feed channel 410. The pressurized oil overcomes the biasing force from spring 380 and thus translates high lift locking pin 370 into central connecting rocker locking mechanism bore 190 thereby engaging high lift rocker 80 to central connecting rocker 90. In addition, pressurized oil is supplied to the low lift locking mechanism bore 170 to overcome the basing force of spring 280 and translate low lift locking pin 270 towards end cap 260 and out of central rocker locking mechanism bore 190 thereby disengaging low lift rocker 70 from central connecting rocker 90. Thus, low lift rocker 70 is disengaged from central rocker 90 allowing relative movement between low lift rocker 70 and the other rockers while high lift rocker 80 is engaged with central rocker 90 thereby actuating valves 120 based on input from the camshaft high lift cam lobe profile 30.

In a low lift valvetrain configuration and referring to FIGS. 3A, 4 and 6, a pressurized supply of oil to the locking mechanism bores is not required because low lift locking pin 270 is spring biased into locking mechanism bore 190 and high lift locking pin 370 is spring biased to be positioned in the high lift locking mechanism bore 180 and not in the central locking mechanism bore 190 thereby allowing relative movement between central rocker 90 and high lift rocker 80. Thus, in the absence of oil pressure being supplied to rocker arm assembly 60 via rocker shaft 100, rocker arm assembly 60 will operate in a low lift configuration actuating valves 120 based on input from camshaft low lift cam lobe profile 30 to low lift rocker assembly 70. High lift rocker 80 will be actuated by camshaft 20 via high lift cam lobe profile 40, but will move independently of central rocker 90 and thus not actuate valves 120.

In operation for a cylinder deactivation configuration and referring to FIGS. 3B, 4 and 8, pressurized oil is supplied to the low lift locking mechanism bore 170 in the same manner as described above for operation in the high lift valvetrain configuration. As the high lift locking pin 370 is spring biased to a disengaged position within the high lift rocker 80, supplying pressurized oil to only the low lift locking mechanism bore results in both the low lift rocker 70 and the high lift rocker 80 being disengaged and thus able to move independently of the central rocker 90. With the central rocker 90 disengaged from the high and low lift rockers 70, 80, respectively, camshaft input from the high and low lift cam lobe profiles does not actuate valves 120 thereby providing for a cylinder deactivation valvetrain configuration.

It should be appreciated that various combinations of high or low lift rockers can be utilized with the central rocker shaft depending on valvetrain requirements. For example, the central connecting rocker could be utilized in combination with only the low lift rocker resulting in a valvetrain capable of no cylinder deactivation and low lift configurations. Alternatively, the central connecting rocker could be utilized in combination with only the high lift rocker resulting in a valvetrain capable of cylinder deactivation and high lift configurations.

The valvetrain of the present invention thus offers modular valvetrain capability which provides design and manufacturing flexibility for a common engine architecture adaptable for high, low and no lift valvetrain configurations depending on needs of various vehicle applications for the common engine architecture.

The foregoing description constitutes the embodiments devised by the inventors for practicing the invention. It is apparent, however, that the invention is susceptible to modification, variation, and change that will become obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

What is claimed is:

1. A valvetrain system for an engine, the valvetrain system comprising:

a low lift rocker arm rotateably connected to a rocker shaft and arranged to engage a camshaft;

a high lift rocker arm rotateably connected to the rocker shaft and arranged to engage the camshaft;

a connecting rocker arm rotateably connected to the rocker shaft and in engagement with a valve;

a low lift locking mechanism bore positioned in the low lift rocker arm for housing a low lift pin assembly, the low lift locking mechanism bare having a longitudinal axis parallel to a longitudinal axis of the rocker shaft; and a high lift locking mechanism bore positioned in the high lift rocker arm for housing a high lift pin assembly, the high lift locking mechanism bore having longitudinal axis parallel to the longitudinal axis of the rocker shaft;

wherein the connecting rocker arm is ranged to operate in selective engagement with a one of the low lift rocker arm and the high lift rocker arm to provide a variable lift deactivateable valvetrain configuration.

2. The valvetrain system of claim 1, wherein the camshaft includes a low lift cam lobe profile and a high lift cam lobe profile, the low lift rocker arm ranged to engage the low lift cam lobe profile and the high lift rocker arm arranged to engage the high lift cam lobe profile.

3. The valvetrain system of claim 1, wherein the low lift and high lift pin assemblies are arranged to selectively engage the connecting rocker arm responsive to oil pressure above a predetermined threshold directed to a one of the low and high lift pin assemblies.

4. The valvetrain system of claim 1, wherein the low lift pin assembly comprises:

a pin and a spring biasing the pin partially into an adjacent bore in the connecting rocker arm thereby engaging the low lift rocker arm to the connecting rocker arm to provide a low lift valvetrain configuration.

5. The valvetrain system of claim 4, further comprising:

an oil feed passage positioned in the low lift rocker arm and arranged in fluid communication with the rocker shaft and the low lift locking mechanism bore;

wherein responsive to oil pressure above a predetermined threshold in the low lift rocker arm oil feed passage, the low lift pin is arranged to overcome the low lift pin spring biasing and translate into the low lift locking mechanism bore thereby disengaging the low lift rocker arm from the connecting rocker arm to provide a cylinder deactivation valvetrain configuration.

6. The valvetrain system of claim 4, wherein oil pressure above a predetermined threshold is selectively provided internal to the rocker shaft and arranged to selectively pressurize the low lift rocker arm oil feed passage.

7. The valvetrain system of claim 4, wherein the camshaft includes a low lift cam lobe profile and the low lift rocker arm is arranged to engage the low lift cam lobe profile.

8. The valvetrain system of claim 1, further comprising:

an oil feed passage positioned in the high lift rocker arm and arranged in fluid communication with the rocker shaft and the high lift locking mechanism bore; and wherein the high lift pin assembly comprises a pin and a spring biasing the pin away from an adjacent bore in the connecting rocker arm;

wherein responsive to oil pressure above a predetermined threshold in the high lift rocker arm oil feed passage, the high lift pin is arranged to overcome the spring biasing and translate into the adjacent bore in the connecting rocker arm thereby engaging the high lift rocker arm to the connecting rocker arm to provide a high lift valvetrain configuration.

9. The valvetrain system of claim 8, wherein oil pressure above a predetermined threshold is selectively provided internal to the rocker shaft and arranged to selectively pressurize the high lift rocker arm oil feed passage.

10. The valvetrain system of claim 8, wherein the camshaft includes a high lift cam lobe profile and the high lift rocker arm is arranged to engage the high lift cam lobe profile.

11. The valvetrain system of claim 1, further comprising:

an oil feed passage positioned in the low lift rocker arm and arranged in fluid communication with the rocker shaft and the low lift locking mechanism bore, and wherein the low lift pin assembly is biased partially into an adjacent bore in the connecting rocker arm thereby engaging the low lift rocker arm to the connecting rocker arm to provide a low lift valvetrain configuration; and an oil feed passage positioned in the high lift rocker arm and arranged in fluid communication with the rocker shaft and the high lift locking mechanism bore;

wherein responsive to selective oil pressure above a predetermined threshold in the low lift rocker arm oil feed passage, the low lift pin assembly is arranged to overcome the biasing and translate into the low lift locking mechanism bore thereby disengaging the low lift rocker arm from the connecting rocker arm to provide a cylinder deactivation valvetrain configuration, and wherein responsive to selective oil pressure above a predetermined threshold in the high lilt rocker arm oil feed passage and the low lift rocker anti oil feed passage, the low lift pin assembly is arranged to overcome the biasing and translate into the low lift locking mechanism bore thereby disengaging the low lift rocker arm from the connecting rocker arm and the high lift pin assembly is arranged to translate into the adjacent bore in the connecting rocker arm thereby engaging the high lift rocker arm to the connecting rocker arm to provide a high lift valvetrain configuration.

12. The valvetrain system of claim 11, wherein oil pressure above a. predetermined threshold is selectively provided internal to the rocker shaft and arranged to selectively pressurize the low lift rocker arm and high lift rocker arm oil feed passages.

13. The valvetrain system of claim 11, wherein the camshaft includes a low lift cam lobe profile and a high lift cam lobe profile, and wherein the low lift rocker arm is arranged to engage the low lift cam lobe profile and the high lift rocker arm is arranged to engage the high lift cam lobe profile.

14. The valvetrain system of claim 1, wherein the low lift pin assembly includes a low lift pin and a spring biasing the low lift pin partially into an adjacent bore in the connecting rocker arm thereby engaging the low lift rocker arm to the connecting rocker arm to provide a low lift valvetrain configuration in the absence of oil pressure above a predetermined threshold in the low lift rocker arm oil feed passage, and wherein the high lift pin assembly includes a high lift pin and a spring biasing the high lift pin into the high lift rocker arm bore thereby enabling the connecting rocker arm to move independently of the high lift rocker arm in the absence of oil pressure above a predetermined threshold in the high lift rocker arm oil feed passage.

15. The valvetrain system of claim 14, wherein responsive to oil pressure above a predetermined threshold in the low lift rocker arm oil feed passage and an absence of oil pressure above a predetermined threshold in the high lift rocker arm oil feed passage, the low lift pin is arranged to overcome the low lift pin spring biasing and translate into the low lift locking mechanism bore thereby enabling the connecting rocker arm to move independent of the low lift and high lift rocker arms thus disengaging input from the camshaft to the valve to provide a cylinder deactivation valvetrain configuration.

16. The valvetrain system of claim 14, wherein responsive to oil pressure above a predetermined threshold in the low lift rocker arm oil feed passage and the high lift rocker arm oil feed passage, the low lift pin is arranged to overcome the low lift pin spring biasing and translate into the low lift locking mechanism bore thereby disengaging the low lift rocker arm from the connecting rocker arm and the high lift pin is arranged to overcome the high lift pin spring biasing and translate into the connecting rocker arm thereby engaging the connecting rocker arm to the high lift rocker arm and providing a high lift valvetrain configuration.

17. The valvetrain system of claim 1, wherein the connecting rocker aim is positioned between the high lift and the low lift rocker arms.

* * * * *